US005888104A

United States Patent [19]

Mello et al.

[11] Patent Number: 5,888,104

[45] Date of Patent: Mar. 30, 1999

[54] PAINT PENETRATING GROUND CLAMP FOR PAINTED RAISED FLOOR PEDESTALS

[75] Inventors: Keith F. Mello, Manchester; H. Thomas Nelson, Bedford, both of N.H.

[73] Assignee: Framatome Connectors USA, Inc., Fairfield, Conn.

[21] Appl. No.: 917,754

[22] Filed: Aug. 27, 1997

Related U.S. Application Data

[60] Provisional application No. 60/038,740 Mar. 10, 1997.

[51] Int. Cl.[6] ..... H01R 4/46

[52] U.S. Cl. ..... 439/785; 439/100

[58] Field of Search ..... 439/388, 433, 439/434, 435, 444, 804, 100, 811

[56] References Cited

U.S. PATENT DOCUMENTS 3,901,577 8/1975 Philibert et al. ..... 339/265 F
4,875,864 10/1989 Campbell ..... 439/100
5,004,437 4/1991 Walter et al. ..... 439/811

FOREIGN PATENT DOCUMENTS 2070302 12/1992 Canada .

OTHER PUBLICATIONS

Electrical Master Catalog, The Electrical Connector Selector, Framatome Connectors International, pp. D–22:D–28, 1996.

*Primary Examiner*—Gary Paumen
*Assistant Examiner*—Briggitte R. Hammond
*Attorney, Agent, or Firm*—Perman & Green, LLP

[57] ABSTRACT

An electrical grounding connector comprising a U-bolt, an upper clamp part and a lower clamp part. The upper clamp part is connected to the U-bolt to clamp a floor pedestal therebetween. The lower clamp part is connected to the U-bolt to clamp a conductor between the upper and lower clamp parts. The upper clamp part has a plurality of barbs therein to penetrate through paint on the floor pedestal. The barbs are formed by piercing into a pedestal contact surface of the upper clamp part at an acute angle to the surface.

18 Claims, 4 Drawing Sheets

PAINT PENETRATING GROUND CLAMP FOR PAINTED RAISED FLOOR PEDESTALS

CROSS-REFERENCE TO RELATED APPLICATION

This application claims the benefit of U.S. Provisional Application No. 60/038,740, filed Mar. 10, 1997.

BACKGROUND OF THE INVENTION

1. Field of the Invention

The present invention relates to electrical connectors and, more specifically, to an electrical grounding connector clamped to a support.

2. Prior Art

U.S. Pat. No. 5,004,437 discloses an electrical connector having a base member and a movable clamp member to clamp a wire therebetween. A requirement has arisen to properly ground newly designed painted raised floor pedestals which are used in earthquake and other critical applications. These pedestals are used to raise flooring for computer rooms and telecommunications equipment areas, in addition to other applications.

A set number of pedestals per square area is required to be bonded using copper conductor with a range of #6 awg to 2/0 awg. A single conductor, or a combination of two conductors, are attached perpendicularly to the pedestal. Currently these pedestals are being bonded with the use of the Burndy GAR1726 ground clamp connector attached to the bare metal surface, thus enabling an effective electrical connection. The removal of the paint from the pedestals to provide the bare metal surface is time consuming and costly for the installers of these connectors. It was desired to develop a connector that would make such removal of paint unnecessary. This connector would have some means that would penetrate the paint when installed, making a proper connection. The connector must meet all requirements of UL standard 467 Grounding and Bonding Equipment for the intended conductor range. The connector is also required to stand up to the rigors of the extreme conditions of an earthquake and still maintain electrical contact.

SUMMARY OF THE INVENTION

The present invention comprises a cast copper alloy ground clamp that attaches to painted metallic raised floor pedestals which permits, during installation, connection to stranded or solid copper conductors. The surface of the groove of the connector which accepts the painted metallic raised floor pedestal is deformed in such a manner that a series of pointed "barbs" or sharp edges penetrate the painted surface when the connector is securely attached, thus enabling an electrical connection with relatively low resistance.

The solution was to modify a standard GP type connector, such that the groove that accepts the pedestal is pierced to create a series of barbs or sharp edges. The sharp edges formed by these barbs contact the surface of the pedestal. When the U-bolt of the connector is tightened to its proper torque, these edges penetrate through the paint enabling contact with the metallic pedestal and the connector.

A cast copper alloy ground clamp is provided that attaches to painted metallic raised floor pedestals which permits during installation, connection to stranded or solid copper conductors. The surface of the groove of the connector, which accepts the painted metallic raised floor pedestal, has a series of barbs of sharp edges. These barbs form sharp edges. When the connector is assembled, and is tightened to the required torque, these edges penetrate through the painted surface of the pedestal thereby making contact with the metallic portion of the pedestal, thus enabling an electrical connection with relatively low resistance.

In accordance with one embodiment of the present invention, an electrical grounding connector is provided comprising a U-bolt, and upper clamp part and a lower clamp part. The upper clamp part is connected to the U-bolt to clamp a floor pedestal therebetween. The lower clamp part is connected to the U-bolt to clamp a conductor between the upper and lower clamp parts. The upper clamp part has a plurality of barbs or sharp edges therein to penetrate through paint on the floor pedestal. The barbs are formed by piercing into a pedestal contact surface of the upper clamp part at an acute angle to the surface.

In accordance with another embodiment of the present invention, an electrical grounding connector is provided comprising a first clamp member, a second clamp member and conductor retaining means. The second clamp member is removably connected to the first clamp member to clamp a floor pedestal therebetween. The conductor retaining means mechanically and electrically connect a conductor to the first clamp member. The first clamp member has a barb or a sharp edge thereon to penetrate through an exterior surface of the floor pedestal to a metal substrate of the floor pedestal making electrical contact between the first clamp member and the floor pedestal.

In accordance with yet another embodiment of the present invention, an electrical grounding connector is provided comprising a central clamp support, means for clamping the central clamp support to a floor pedestal and conductor retaining means. The conductor retaining means mechanically and electrically connect a conductor to the central clamp support. The central clamp support comprises self-effecting contact means so that, when the central clamp support is clamped to the floor pedestal, the self-effecting contact means make electrical contact with the floor pedestal without prior preparation of an exterior surface of the floor pedestal.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
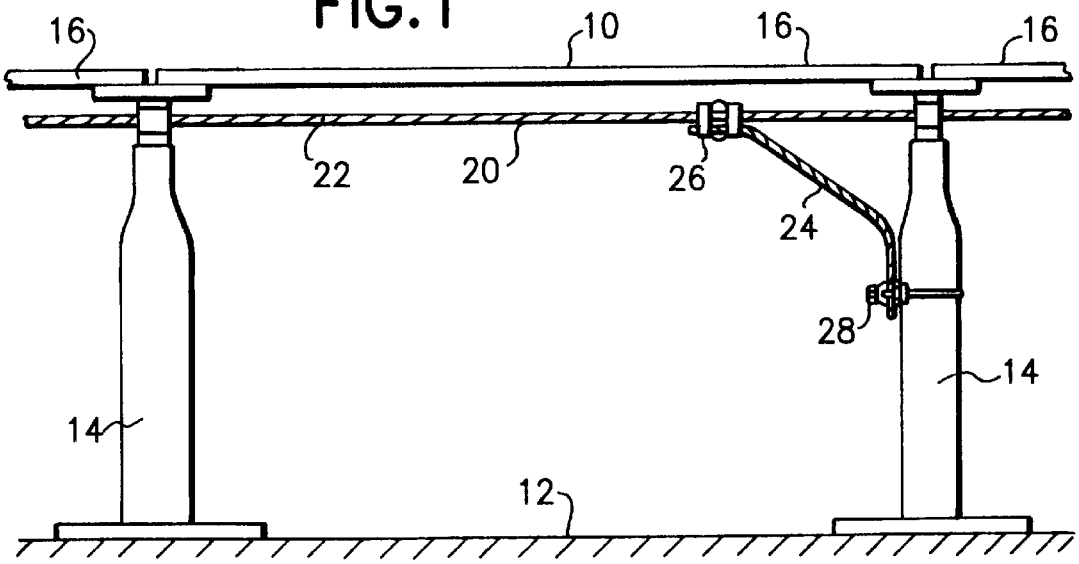
FIG. 1 is a schematic elevational view of a floor system and grounding system having an electrical grounding connector incorporating features of the present invention.

Referring to FIG. 1, there is shown a schematic view of a floor system 10 and a grounding system 20 incorporating features of the present invention. Although the present invention will be described with reference to the embodiments shown in the drawings, it should be understood that the present invention can be embodied in various different types of alternate embodiments. In addition, any suitable size, shape or type of elements or materials could be used.

The floor system 10, shown in FIG. 1, comprises a foundation slab 12, a plurality of pedestals 14 and a plurality of floor structural portions or tiles 16. The pedestals 14 support the floor tiles 16 a spaced distance from the foundation 12. The grounding system 20 comprises a main grounding conductor 22, a tap conductor 24, a tap-main connector 26 and a grounding connector 28. The grounding system 20 is attached to the pedestals 14. The main grounding conductor 22 generally spans between pedestals 14. The tap conductor 24 extends from a pedestal 14 to the main grounding conductor 22. The tap conductor 24 is mechanically and electrically connected to the main conductor 22 by the tap-main connector 26. The tap conductor 24 is electrically and mechanically connected to the floor pedestal 14 by the grounding connector 28. Thus, the pedestal 14 is grounded to the grounding system 20.

Figure 2:
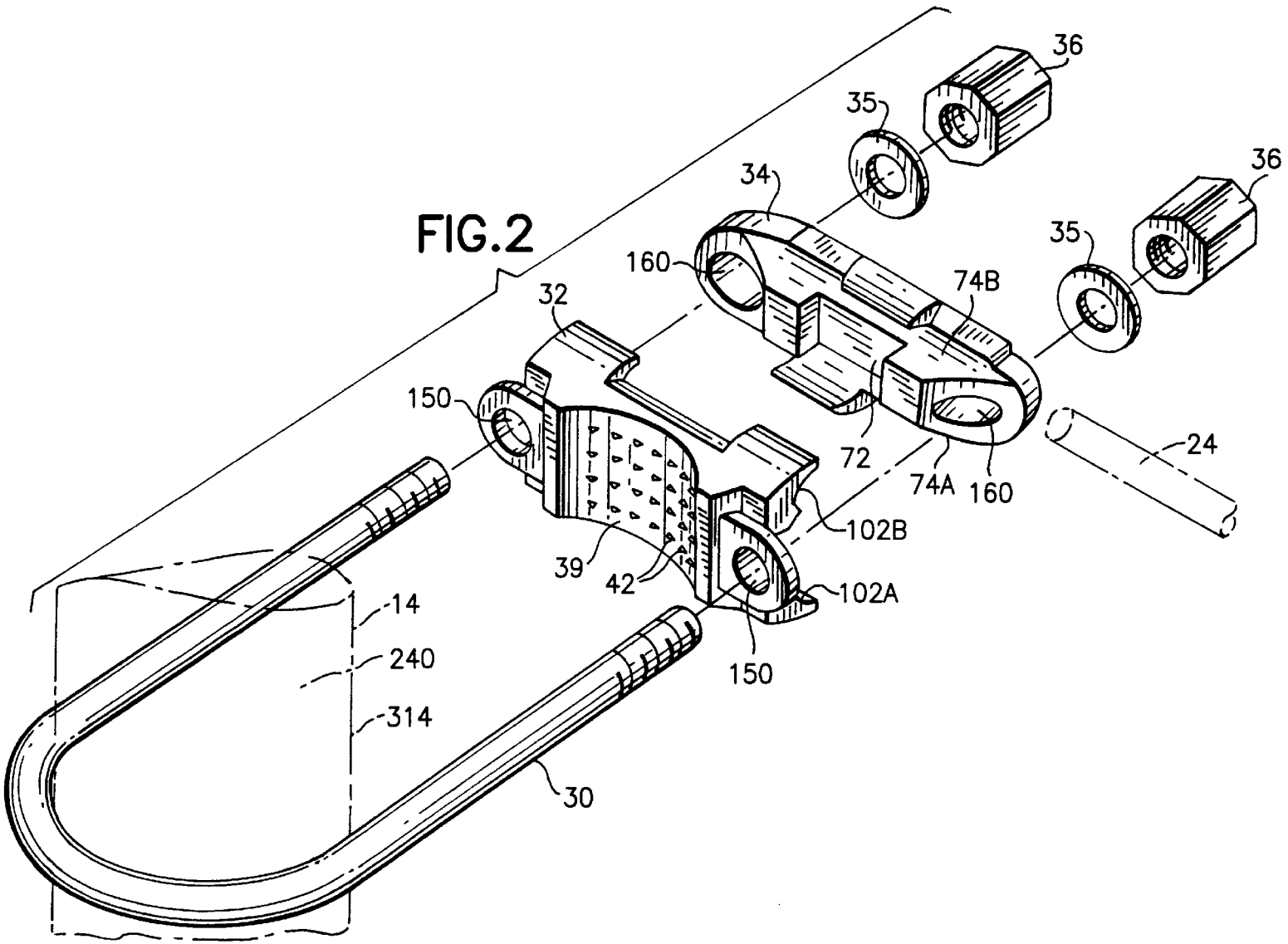
FIG. 2 is an exploded perspective view of the grounding connector used between the floor pedestal and the tap conductor shown in FIG. 1.

Referring also to FIG. 2, the electrical grounding connector 28 generally comprises a U-bolt 30, an upper clamp part 32, a lower clamp part 34, two lock washers 35 and two nuts 36. The upper clamp part 32 is connected to the U-bolt 30 to clamp a cylindrical section 240 of the floor pedestal 14 therebetween. Clamping the upper clamp part 32 to the floor pedestal 14 establishes an electrical connection between the connector 28 and pedestal 14. The lower clamp part 34 is connected to the upper clamp part 32 and the U-bolt 30 to clamp the tap conductor 24 between the upper clamp part 32 and lower clamp part 34. Clamping the tap conductor 24 between the upper clamp part 32 and the lower clamp part 34 creates an electrical connection between the connector 28 and conductor 24. Thus, the floor pedestal 14 is electrically connected by the grounding connector 28 to the tap conductor 24.

Figure 3:
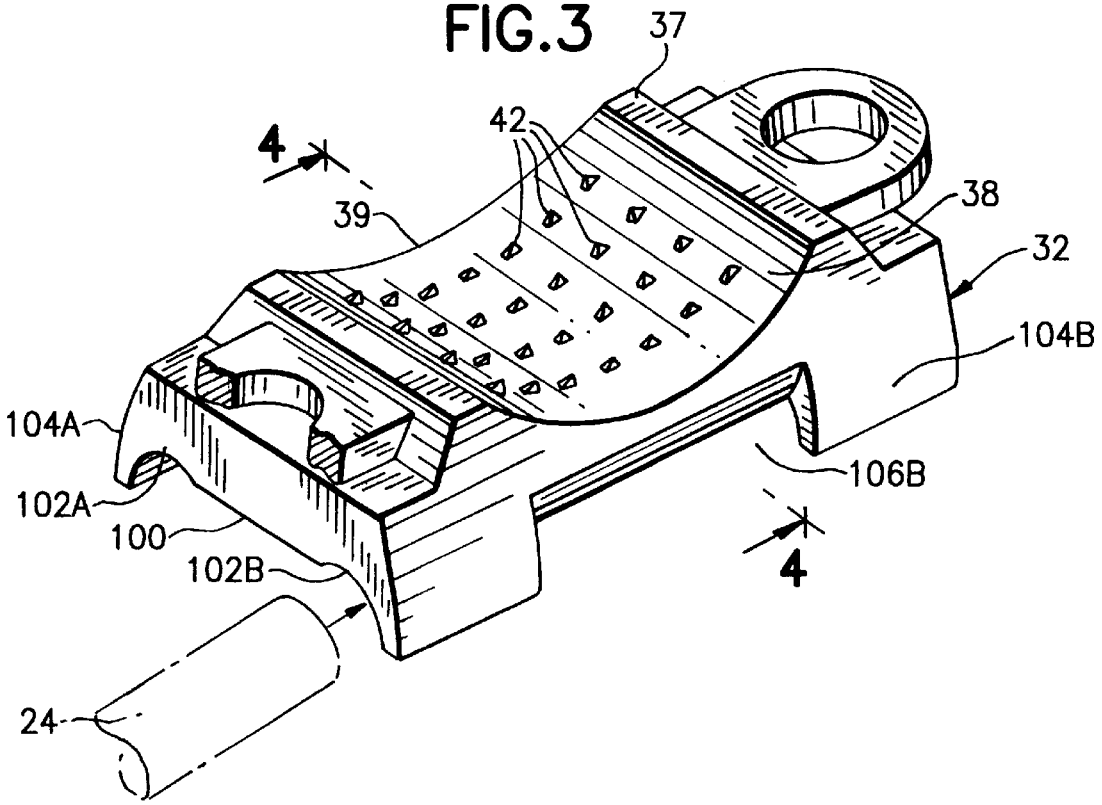
FIG. 3 is a perspective view of the upper clamp part of the electrical grounding connector shown in FIG. 2.
Figure 4:
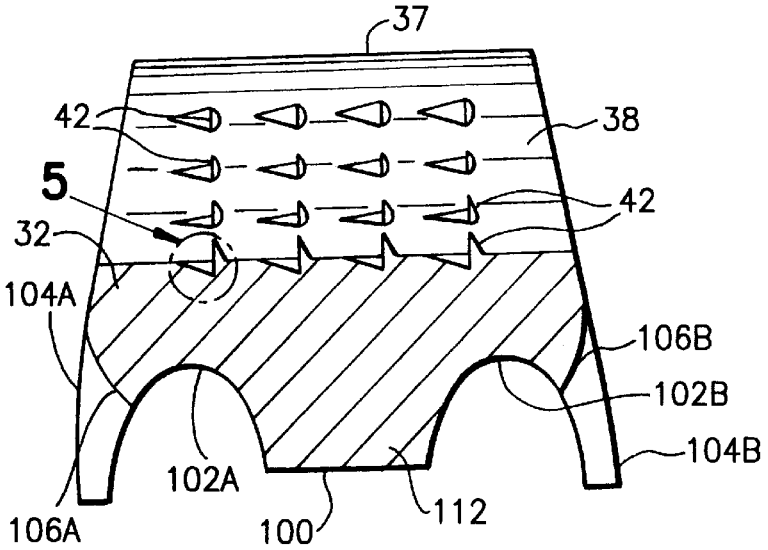
FIG. 4 is a cross-sectional view of the upper clamp part shown in FIG. 3 taken along line 4—4.
Figure 5:
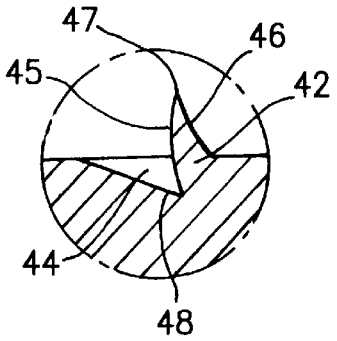
FIG. 5 is an enlarged cross-section view of the barb detail formed in the surface of the upper clamp part of area 5 shown in FIG. 4.
Figure 8:
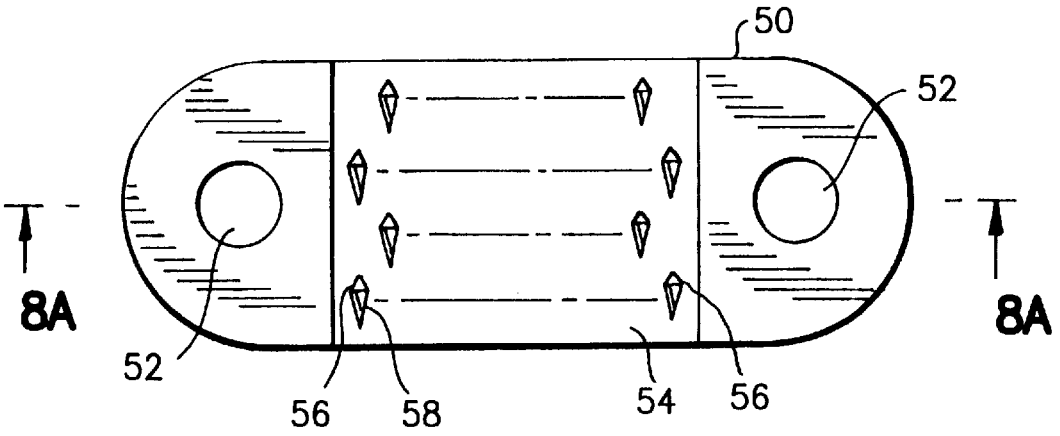
FIG. 8 is a top plan view of an alternate embodiment of an upper clamp part.
Figure 8A:
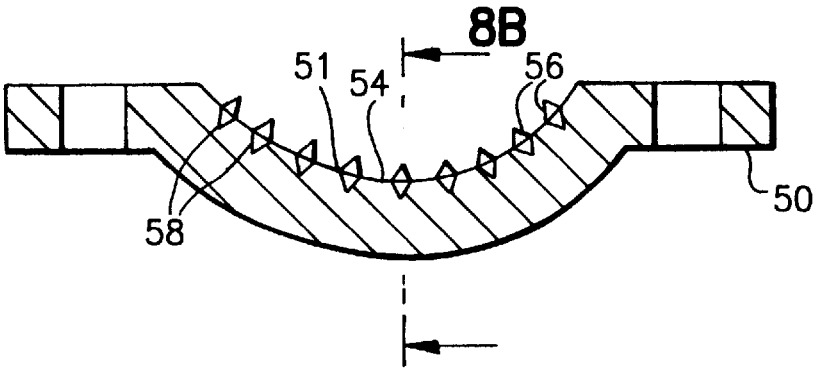
FIG. 8A is a cross-sectional view of the upper clamp part shown in FIG. 8 taken along line 8A—8A.
Figure 8B:
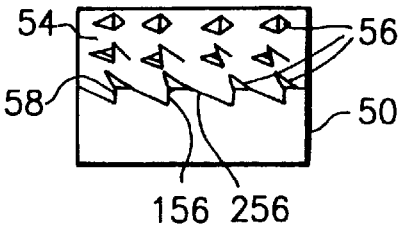
FIG. 8B is a cross sectional view of the upper clamp part shown in FIG. 8A taken along line 8B—8B.

Referring also to FIG. 3, in the first preferred embodiment of the invention, the upper clamp part 32 is made from metal and has an upper surface 37 with a pedestal receiving area 39 formed therein. The pedestal receiving area 39 generally conforms to an exterior surface of the floor pedestal 14. Referring also to FIGS. 4 and 5, the surface 38 of the receiving area 39 has barbs or sharp edges 42 projecting therefrom. In the preferred embodiment, each barb 42 has a general claw shaped longitudinal cross-section aligned generally parallel to the longitudinal axis of the pedestal receiving area 39. The claw shaped cross-section of each barb 42 has a first surface 45 and a second surface 46. The first surface 45 of the barb 42 generally curves, with an increasing slope, away from the surface 38 of the pedestal receiving area 39. The second surface 46 of the barb 42, is also generally curved and intersects the first surface 45 to form a sharp tip 47. The first and second surfaces 45, 46 define the claw shaped cross-section of each barb 42 with a tapering width ending in the sharp tip 47 (see FIG. 5). At the tip 47, the second surface 46 and the first surface 45 are angled generally perpendicular to the surface 38 of the pedestal receiving area 39. In an alternate embodiment, as depicted in FIG. 8B, each barb has a first surface 156 and a second surface 256 which are substantially straight to form a general blade shaped profile. In other alternate embodiments, the curvature of the first and second surfaces of each barb may vary. The barbs 42 are formed by piercing the surface 38 of the pedestal receiving area 39 at an acute angle to the surface 38. Piercing the surface 38 at an acute angle locally displaces a portion of the surface 38 upward. Each upraised portion of the surface 38 forms a barb 42. A corresponding cavity 44 remains in the surface 38 forward of each barb 42, as shown in FIG. 5. Each cavity 44 extends under the corresponding barb 42 tapering to an acute end 48.

Referring to FIGS. 3 and 4, the upper clamp part 32 has a lower surface 100 with conductor receiving channels 102A, 102B formed therein. In the preferred embodiment, the upper clamp part 32 has two conductor receiving channels 102A, 102B. The channels 102A, 102B are aligned generally perpendicular to the pedestal receiving area 39. Each of the conductor receiving channels 102A, 102B is located proximate one longitudinal side 104A, 104B of the upper clamp part 32. The conductor receiving channels 102A, 102B are separated sufficiently from each other, so that when the tap conductor 24 is located in one channel 102A, 102B and a second conductor (not shown) is located in the second channel, the U-bolt 30 connected to the upper clamp part 32 extends between the conductors. In alternate embodiments, the upper clamp part may have other arrangements of conductor receiving channels. Each longitudinal side 104A, 104B of the upper clamp part 32 has a recess 106A, 106B extending thereinto from the bottom of the clamp part 32. Between the conductor receiving channels 102A, 102B, the lower surface 100 has a keyed section 112 projecting therefrom.

Figure 6:
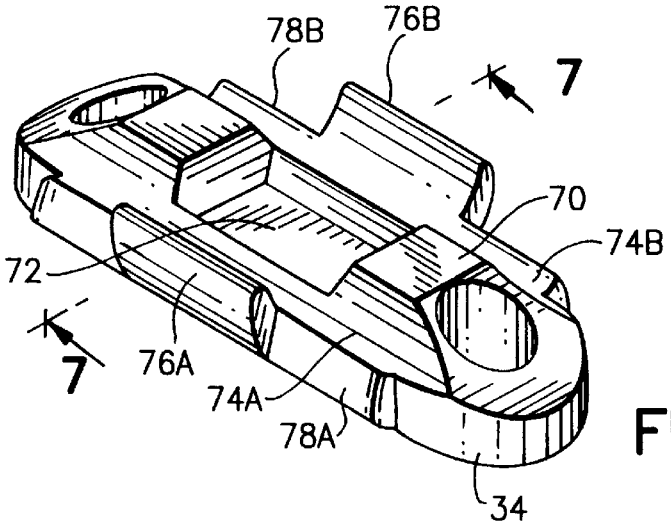
FIG. 6 is a perspective view of the lower clamp part of the electrical grounding connector shown in FIG. 2.
Figure 7:
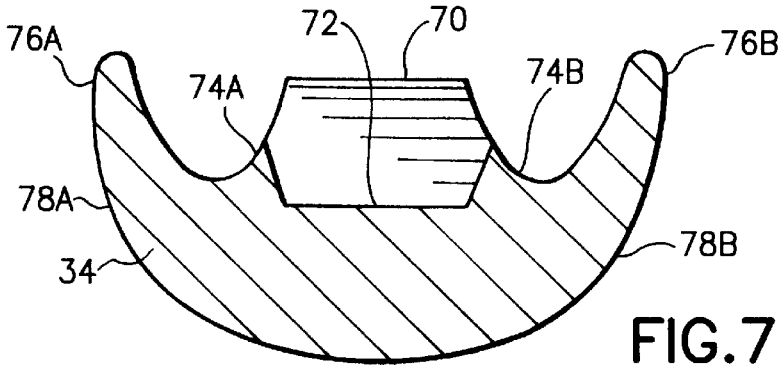
FIG. 7 is a cross-sectional view of the lower clamp part shown in FIG. 6 taken along line 7—7.

Referring also to FIGS. 6 and 7, the lower clamp part 34 has an upper surface 70 with a keyway 72 formed therein. The keyway 72 is adapted to receive the keyed section 112 of the upper clamp part 32 when it is mated to the lower clamp part 34. The lower clamp part 34 has two conductor receiving channels 74A, 74B longitudinally astride the keyway 72. The conductor receiving channels 74 are located in the lower clamp part 34 to generally align with the corresponding conductor receiving channels 102A, 102B in the upper clamp part 32, when the key section 112 of the upper clamp part 32, is located in the keyway 72. Outer side supports 76A, 76B extend upward from each longitudinal side 78A, 78B of the lower clamp part 34. The outer supports 76A, 76B are adapted to be admitted in the corresponding side recesses 106A, 106B of the upper clamp part 32 when the upper clamp part 32 and the lower clamp part 34 are joined.

As seen in FIG. 2, the ground connection between the floor pedestal 14 and the tap conductor 24 is formed by clamping the grounding connector 28 to the floor pedestal 14 and connecting the tap conductor 24 to the grounding connector 28. To clamp the connector 28 to the floor pedestal 14, the upper clamp part 32 is placed against the cylindrical section 240 of the floor pedestal 14 so that a portion thereof is located in the pedestal receiving area 39. The U-bolt 30 is positioned around the floor pedestal 14 and inserted through the holes 150 in the upper clamp part 32 capturing the floor pedestal 14 between the U-bolt 30 and the upper clamp part 32. The tap conductor 24 is placed into one of the conductor receiving channels 102A, 102B in the upper clamp part 32 of the ground connector 28. The lower clamp part 34 is mated to the upper clamp part 32. When mating the upper clamp part 32 and lower clamp part 34, the key section 112 of the upper clamp part 32 is received in the keyway 72 of the lower clamp part 34 aligning the conductor receiving channels 102A, 102B in the upper clamp part 32 with the conductor receiving channels 74A, 74B in the lower clamp part 34. The U-bolt 30 is inserted through the holes 160 in the lower clamp part 34. The ground connector 28 assembly is completed by placing the lock washers 35 on the U-bolt 30 and threading on the nuts 36.

Referring still to FIG. 2, threading the nuts 36 on the U-bolt 30 draws the U-bolt 30 into the upper clamp part 32 generating clamping forces on the floor pedestal 14 captured therebetween. The barbs 42 contact the floor pedestal 14 and, under the clamping pressure, the sharp tips 47 of the barbs 42 penetrate through the exterior surface 314 into the metal substrate of the floor pedestal 14 to effect the electrical connection between it and the connector 28. The engagement of the barbs 42 with the floor pedestal 14 also establishes a positive mechanical connection between the connector 28 and pedestal 14 preventing longitudinal movement of the connector 28. Threading the nuts 36 on the U-bolt 30 also urges the upper clamp part 32 against the lower clamp part 34 clamping the tap conductor 24 held in the conductor receiving channel 102A, 102B, of the upper clamp part 32, and the corresponding channel 74A, 74B of the lower clamp part 34. The lower surface 100 of the upper clamp part 32 seats against the mating upper surface 70 of the lower clamp part 34 so that compression forces sufficient to drive the barbs 42 in the floor pedestal 14 may be transmitted from the lower clamp part 34 into the upper clamp part 32 without excessively crushing or cutting the conductor 24. As the upper clamp part 32 and the lower clamp part 34 are drawn together, the side supports 76A, 76B on the lower clamp part 34 enter the recesses 106A, 106B in the upper clamp part 32. The corresponding support 76A, 76B laterally restrains the conductor 24 as it is clamped between the upper clamp part 32 and lower clamp part 34, to ensure that the conductor 24 does not deform and exit the conductor receiving channels, and hence is not excessively damaged when the connector 28 is clamped to the floor pedestal 14. Clamping the conductor 24 between the upper clamp part 32 and lower clamp part 34 creates the electrical connection between the connector 28 and conductor 24.

The present invention provides a grounding connector 28 that self-effects an electrical connection between the connector 28 and the floor pedestal 14 when the connector 28 is clamped on the floor pedestal 14 without prior preparation of the surface 314 of the pedestal 14. The floor pedestals 14 are protected against corrosion by paint applied to the exterior. Hence, prior preparation of the exterior surface 314 of the pedestal 14 is needed to provide a clean contact surface when using the old type of grounding connectors known in the art. In contrast, the present invention allows the user to ground the floor pedestal 14 by merely clamping the grounding connector 28 to the floor pedestal 14. The user need no longer prepare the exterior surface 314 of the floor pedestal 14 in advance of connecting the ground connector 28. Unlike connectors known in the art, barbs 42 on the grounding connector 28 of the present invention penetrate through the painted surface 314 into the metal of the floor pedestal 14 during clamping of the connector 28, thus effecting the electrical ground connection between connector 28 and floor pedestal 14. The grounding connector 28 of the present invention eliminates the time consuming, and hence, costly step of preparing the exterior surface of the floor pedestal 14.

The present invention also provides a grounding connector 28 which, when clamped to the floor pedestal 14, forms a positive mechanical connection therewith that enables the ground connector to withstand the rigors of the extreme vibratory conditions of an earthquake and still maintain electrical contact. Ground connectors known in the art generally rely on friction to maintain the electrical connection. However, under seismic vibration, friction forces may be overcome causing these ground connectors to slip on the floor pedestals breaking the electrical contact therebetween. The barbs 42 on the ground connector 28 of the present invention penetrate into and engage the metal of the floor pedestal when the ground connector 28 is clamped to the floor pedestal 14. Once the ground connector 28 is clamped to the floor pedestal 14, the ground connector 28 will slip only if the barbs 42 engaging the pedestal 14 material are sheared off. Hence, mere loss of friction between the ground connector 28 and floor pedestal, which may occur under seismic conditions, will not cause the grounding connector 28 to slip and will not adversely affect the electrical connection between the connector 28 and pedestal 14.

The present invention allows the user to ground a floor pedestal 14 by merely clamping the grounding connector 28 thereon. The present invention will also maintain the ground connection between the grounding connector 28 and floor pedestal 14 under seismic conditions. In alternate embodiments, the user may use the grounding connector 28 of the present invention to ground other structures of the floor system. In other alternate embodiments, the configuration of the parts of the connector may vary. For example, FIGS. 8, 8A and 8B depict an alternate embodiment of the upper clamp part 50. The upper clamp part 50 is made from heavy gauge sheet metal. The upper clamp part 50 is stamped or rolled to form a pedestal receiving area 51. The curved pedestal contact surface 54 of the pedestal receiving area 51 is pierced at an acute angle to the surface 54 forming the barbs 56. A corresponding cavity 58 is formed in front of each barb 56. The upper clamp part has two holes 52 to admit the U-bolt 30.

It should be understood that the foregoing description is only illustrative of the invention. Various alternative and modifications can be devices by those skilled in the art without departing from the scope of the invention. Accordingly, the present invention is intended to embrace all such alternative, modifications and variances which fall within the scope of the appended claims.

What is claimed is:

1. An electrical grounding connector comprising:

a U-bolt;

an upper clamp part connected to the U-bolt to clamp a floor pedestal therebetween; and a lower clamp part connected to the U-bolt to clamp a conductor between the upper and lower clamp parts, wherein the upper clamp part has a plurality of barbs therein to penetrate through paint on the floor pedestal, and wherein each barb of the plurality of barbs has a cross-section with a tapering width ending in a sharp tip formed by piercing into a pedestal contact surface of the upper clamp part at an acute angle to the surface.

2. An electrical grounding connector as in claim 1, wherein the pedestal contact surface of the upper clamp part has a plurality of cavities formed therein, each of the cavities being located in front of and extending under a corresponding one of the barbs.

3. An electrical grounding connector as in claim 2, wherein each of the cavities has a bottom surface at an acute angle to the contact surface of the upper clamp part, and a top surface angled to the bottom surface to intersect the bottom surface, so that the cavity terminates in an acutely tapered end.

4. An electrical grounding connector as in claim 1, wherein the upper clamp part has an upper surface with a pedestal receiving area formed therein to receive a portion of the floor pedestal when the upper clamp part is clamped to the floor pedestal, the pedestal receiving area comprising the pedestal contact surface of the upper clamp part.

5. An electrical grounding connector as in claim 1, wherein each of the barbs is longitudinally aligned generally parallel to a longitudinal axis of the floor pedestal when the upper clamp part is clamped to the floor pedestal.

6. An electrical grounding connector as in claim 1, wherein the upper clamp part has a lower surface with a first conductor receiving channel adapted to receive a portion of the conductor when the conductor is clamped between the upper clamp part and lower clamp part.

7. An electrical grounding connector as in claim 6, wherein the first conductor receiving channel is aligned generally perpendicular to a longitudinal axis of a pedestal receiving area of the upper clamp part.

8. An electrical grounding connector as in claim 6, wherein the lower clamp part has an upper surface with a second conductor receiving channel, the second conductor receiving channel cooperating with the first conductor receiving channel in the upper clamp part when the upper clamp part and lower clamp part are connected to the U-bolt to hold the conductor.

9. An electrical grounding connector as in claim 8, wherein the lower surface of the upper clamp part has a key projecting therefrom and the upper surface of the lower clamp part has a complementing keyway formed therein, wherein when the lower clamp part is connected to the upper clamp part the key is located in the keyway, so that, when the conductor is received in both the first conductor receiving channel and in the second conductor receiving channel, the upper clamp part and the lower clamp part achieve clamping pressure on the conductor.

10. An electrical grounding connector comprising:

a first clamp member;

a second clamp member removably connected to the first clamp member to clamp a floor pedestal therebetween; and conductor retaining means for mechanically and electrically connecting a conductor to the first clamp member;

wherein the first clamp member has a barb thereon to penetrate through an exterior surface of the floor pedestal to a metal substrate of the floor pedestal to make electrical contact between the first clamp member and the floor pedestal, and wherein the barb is formed by piercing at an acute angle into a contact surface of the first clamp member so that the barb has a cross-section with a tapering width ending in a sharp tip.

11. An electrical grounding connector as in claim 10, wherein the first clamp member has an upper surface with a pedestal receiving channel formed therein, the pedestal receiving channel having the contact surface having the barb thereon.

12. An electrical grounding connector as in claim 11, wherein the barb has a general claw shaped cross-section, the claw shaped cross-section having a first generally curved surface and a second generally curved surface intersecting the first surface to form a sharp tip of the claw shaped cross-section, wherein at a base portion of the claw shaped cross-section the first surface and the second surface are angled acutely to the contact surface of the first clamp member, and at the tip of the claw shaped cross-section the first surface and the second surface are angled generally perpendicular to the contact surface.

13. An electrical grounding connector as in claim 11, wherein the first clamp member has a plurality of the barbs distributed on the contact surface of the first clamp member.

14. An electrical grounding connector as in claim 10, wherein the barb is longitudinally aligned generally parallel to a longitudinal axis of the floor pedestal, when the first clamp member is clamped to the floor pedestal.

15. An electrical grounding connector as in claim 10, wherein the second clamp member comprises a bolt connecting the conductor retaining means to the first clamp member.

16. An electrical grounding connector as in claim 15, wherein the first clamp member has two conductor receiving chambers formed therein, the conductor receiving channels being aligned generally parallel to a longitudinal axis of the first clamp member, and wherein, when the connector is connected to the first clamp member by the conductor retaining means a portion of the conductor is located in one of the conductor receiving channels.

17. An electrical grounding connector comprising:

a central clamp support;

means for clamping the central clamp support to a floor pedestal; and conductor retaining means for mechanically and electrically connecting a conductor to the central clamp support;

wherein the central clamp support comprises means for effecting electrical contact with the floor pedestal through an exterior surface of the floor pedestal without preparation of the exterior surface of the floor pedestal prior to clamping the central clamp support to the floor pedestal;

and wherein the means for effecting electrical contact comprise an upraised section with a general blade shaped profile, the blade shaped profile having a tapering width ending in a sharp tip to penetrate an exterior of the floor pedestal and contact a metal substrate of the floor pedestal when the central clamp support is clamped to the floor pedestal.

18. An electrical grounding connector as in claim 17, wherein the central clamp support has a portion formed into a generally curved shape to receive a mating portion of the floor pedestal when the central clamp support is clamped to the floor pedestal.

* * * * *